US011225352B2

(12) United States Patent
Bourne

(10) Patent No.: US 11,225,352 B2
(45) Date of Patent: Jan. 18, 2022

(54) PACKAGING AND BLANK THEREFOR

(71) Applicant: MAYR-MELNHOF KARTON AG, Vienna (AT)

(72) Inventor: Timothy John Bourne, Northumberland (GB)

(73) Assignee: MAYR-MELNHOF KARTON AG, Vienna (AT)

( * ) Notice: Subject to any disclaimer, the term of this patent is extended or adjusted under 35 U.S.C. 154(b) by 0 days.

(21) Appl. No.: 16/608,916

(22) PCT Filed: Apr. 28, 2017

(86) PCT No.: PCT/EP2017/060255
§ 371 (c)(1),
(2) Date: Oct. 28, 2019

(87) PCT Pub. No.: WO2018/197017
PCT Pub. Date: Nov. 1, 2018

(65) Prior Publication Data
US 2021/0024243 A1 Jan. 28, 2021

(51) Int. Cl.
*B65D 5/02* (2006.01)
*B65D 5/54* (2006.01)
*B65D 5/66* (2006.01)

(52) U.S. Cl.
CPC ..... *B65D 5/0227* (2013.01); *B65D 5/5425* (2013.01); *B65D 5/6602* (2013.01)

(58) Field of Classification Search
CPC .. B65D 5/0227; B65D 5/5425; B65D 5/6602; B65D 5/029; B65D 5/10; B65D 5/443; B65D 5/4279; B31B 50/28; B31B 50/282
(Continued)

(56) References Cited

U.S. PATENT DOCUMENTS 5,147,271 A 9/1992 Bacques et al.
7,350,670 B2 * 4/2008 Steeves ..... B65D 77/065 222/105
(Continued)

FOREIGN PATENT DOCUMENTS

CN 105121304 A 12/2015
DE 20 2004 011 165 U1 12/2005
(Continued)

OTHER PUBLICATIONS

International Search Report dated Jan. 16, 2018 in corresponding International Patent Application No. PCT/EP2017/060255.
(Continued)

*Primary Examiner* — Christopher R Demeree
(74) *Attorney, Agent, or Firm* — Medler Ferro Woodhouse & Mills PLLC

(57) ABSTRACT

The invention relates to a packaging made from cardboard, paper or similar, including a front wall and a rear wall, respectively at least one lateral wall connecting the front and rear walls and designed to form respective lateral sides of the packaging. The packaging is designed as a prismatic body along a longitudinal axis, and a base construction includes at least one base closure coupled to the front or rear wall for closing the base of the packaging. A cover construction includes at least one cover closure coupled to the front and rear walls for closing the cover of the packaging.

16 Claims, 4 Drawing Sheets

Figure 1:
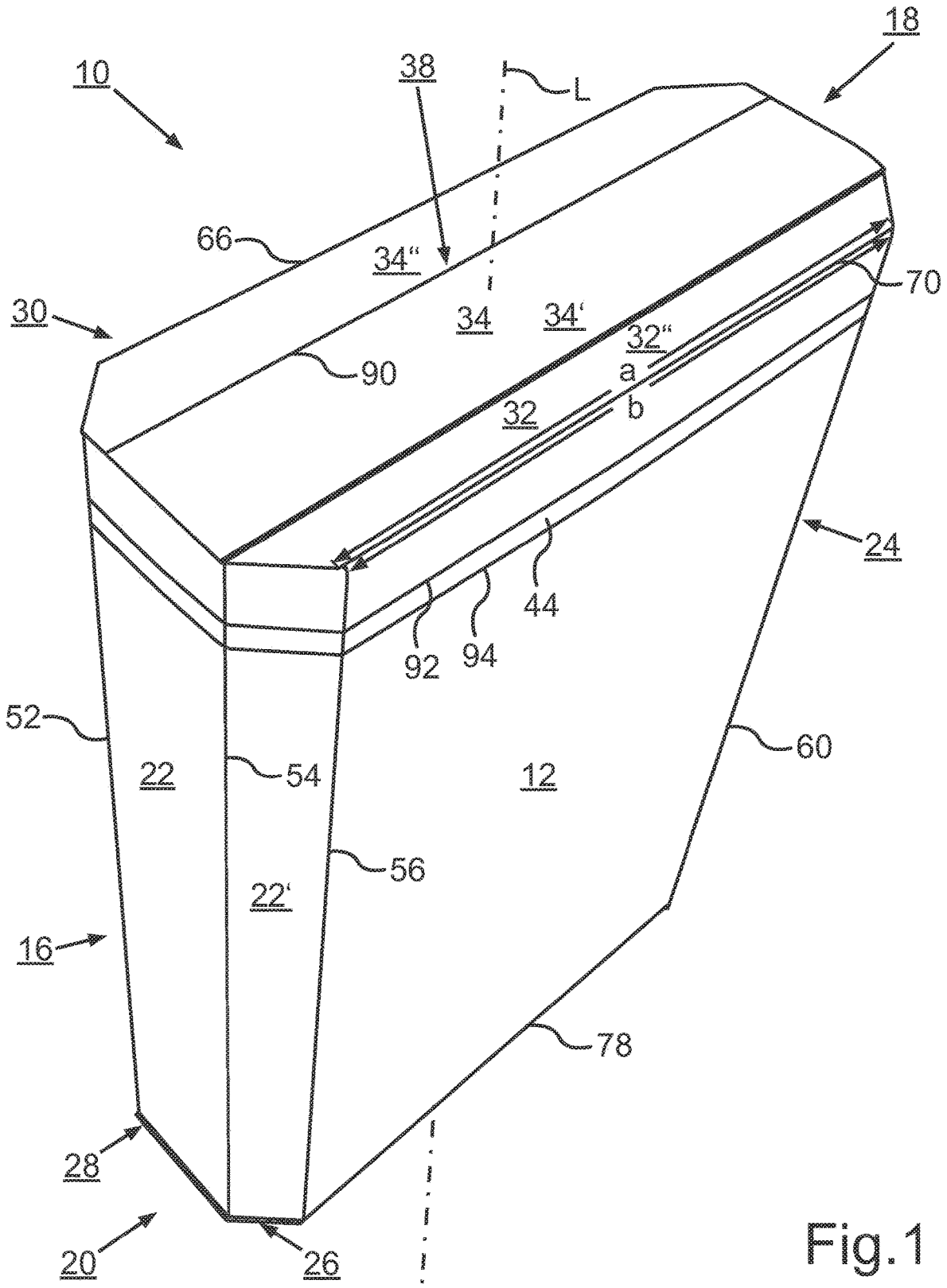

(58) Field of Classification Search
USPC ..... 229/221, 109, 190, 141, 918, 108; 206/509, 521, 586
See application file for complete search history.

(56) References Cited

U.S. PATENT DOCUMENTS

| | | | | |
|---|---|---|---|---|
| 7,857,743 | B2 * | 12/2010 | Barner | B65D 5/48024 493/175 |
| 8,844,797 | B2 | 9/2014 | Smith | |
| 9,022,913 | B2 * | 5/2015 | Graham | B65D 5/0227 493/51 |
| 9,114,921 | B2 * | 8/2015 | Smith | B65D 5/0227 |
| 2008/0203142 | A1 | 8/2008 | Grossman et al. | |
| 2010/0065621 | A1 | 3/2010 | Quaintance | |
| 2010/0219232 | A1 | 9/2010 | Smith | |
| 2011/0111938 | A1 | 5/2011 | Smith | |

FOREIGN PATENT DOCUMENTS

| | | | |
|---|---|---|---|
| EP | 0 468 860 | A1 | 1/1992 |
| JP | 2008-505817 | A | 2/2008 |
| JP | 2010-269800 | A | 12/2010 |
| JP | 2015-030246 | A | 2/2015 |
| RU | 1816276 | A3 | 5/1993 |
| WO | 2015/010726 | A1 | 1/2015 |
| WO | 2015/011186 | A1 | 1/2015 |

OTHER PUBLICATIONS

Russian Office Action dated Sep. 9, 2020 in corresponding Russian Application No. 2019138305/11 (075624).
Russian Search Report dated Sep. 1, 2020 in corresponding Russian Application No. 2019138305/11 (075624).
Chinese Office Action dated Jan. 13, 2021 in corresponding Chinese Patent Application No. 201780089985.1.
Examination Report (Office Action) dated May 11, 2021 in corresponding Japanese Patent Application No. 2019-552624.
Korean Office Action received Aug. 30, 2021 in corresponding Korean Patent Application No. 10-2019-7027329.

* cited by examiner

PACKAGING AND BLANK THEREFOR

The present invention relates to a packaging of cardboard, paper or the like, comprising a front wall and a rear wall, each at least one sidewall connecting the front and rear walls for forming respective end sides of the packaging, wherein the packaging is formed in the shape of a prismatic body along a longitudinal axis, a bottom construction comprising at least one bottom flap hinged to the front or rear wall for bottom-side closure of the packaging and a lid construction comprising at least one lid flap hinged to the front or rear wall for lid-side closure of the packaging. Furthermore, the invention relates to a blank for producing such a packaging.

Such packagings are known in a great plurality. In particular, such packagings are used for filling, the transport and the storage of packaged or unpackaged free-flowing goods. Therein, the goods can for example be cereals, cornflakes or other pourable and free-flowing foods or else washing powder and the like. However, liquids can also be stored in correspondingly liquid-tight intermediate packagings in the mentioned packagings. From DE 20 2004 011 165 U1, a powder-tight packaging for powdery goods is known. Therein, the known packaging is formed in the shape of a prismatic, octagonal body along a longitudinal axis. However, it is disadvantageous in such prismatically formed packagings that multiple dust flaps have to be formed in addition to the lid flaps for sealing the lid and/or bottom construction. In particular in the corner areas of the lid and/or bottom construction, instabilities additionally occur upon pressure loads of these areas, for example in storing or stacking these packagings on top of each other. This can result in undesired damages to the packaging. From US 2011/111938 A1 and EP 0 468 860 A1, cardboard packagings and corresponding blanks according to the features of the preambles of claims 1 and 10 are known.

WO 2015/010726 A1 also shows packagings and blanks according to the preambles of claims 1 and 10. Therein, the dust flaps of the packagings are formed such that they rest on the sidewall or sidewalls, to which they are not hinged, at least in certain areas in the closed state of the packaging. By this known configuration of the dust flap, secure closure and secure coverage in the area of the lid and/or bottom construction of the packaging are given. In addition, increased loading stability of the packaging arises. In machine erection of the blanks of these packagings, i.e. in producing and filling the packaging, however, delays and problems of the automated erecting and filling process can occur in individual cases depending on the erecting speed and the product to be filled due to the complex structure of the dust flaps.

Therefore, it is the object of the present invention to provide a generic packaging and a blank hereto, which, besides secure closure and secure coverage in the area of the lid and/or bottom construction of the packaging, respectively, ensure increased loading stability of the packaging in these areas and additionally allow fast and secure machine production and filling of the packaging with products.

A generic packaging according to the features of claim 1 as well as a blank according to the features of claim 10 serve for solving these objects. Advantageous configurations with convenient developments of the invention are specified in the respective dependent claims, wherein advantageous configurations of the packaging are to be regarded as advantageous configurations of the blank and vice versa.

A packaging according to the invention of cardboard, paper or the like comprises a front wall and a rear wall, each at least one sidewall connecting the front and rear walls for forming respective end sides of the packaging, wherein the packaging is formed in the shape of a prismatic body along a longitudinal axis, a bottom construction comprising at least one bottom flap hinged to the front or rear wall for bottom-side closure of the packaging and a lid construction comprising at least one lid flap hinged to the front or rear wall for lid-side closure of the packaging. Therein, the at least one bottom flap hinged to the front or rear wall and/or the at least one lid flap hinged to the front or rear wall are respectively formed such that they rest on at least one sidewall connecting the front and rear walls at least in certain areas and protrude beyond at least one sidewall, on which they rest, at least in certain areas in a closure position. By such a formation of the bottom and/or lid flap, secure closure and secure coverage of the packaging in the area of the lid and/or bottom construction, respectively, are ensured. Furthermore, by the resting of the bottom and/or lid flap on the sidewall or sidewalls of the packaging at least in certain areas, increased loading stability of the packaging in these areas arises. By "resting on the sidewall or sidewalls", it is also understood that the bottom and/or lid flap do not directly rest on a respective edge of the sidewall. Thus, the bottom and/or lid flap can also rest on a packaging element hinged to the respective sidewall, such as for example a dust flap, at least in certain areas. It is crucial that the bottom and/or lid flap protrude beyond the corresponding sidewall. Therefore, the packagings according to the invention can be stacked on top of each other without problem, which is for example required in shipping on pallets. Furthermore, thinner cardboard thicknesses can be optionally used compared to packagings known heretofore. Finally, the packaging according to the invention ensures fast and secure machine production and filling of the packaging with products. This is attributable to the fact that complex structures of individual elements of the packaging, in particular possible dust flaps, can be omitted. The longitudinal axis of the packaging extends approximately or exactly perpendicularly to a bottom or resting surface and parallel to the longitudinal extension of the front and rear walls of the packaging.

In a further advantageous configuration of the packaging according to the invention, a width a of the at least one bottom flap hinged to the front or rear wall and/or of the at least one lid flap hinged to the front or rear wall is larger than a width b of the front or rear wall in the area of the respective hinge of the bottom and/or lid flap. Thereby, it is ensured in simple constructive manner that the corresponding bottom and/or lid flap rest on the corresponding sidewall or the corresponding sidewalls on the one hand and protrude beyond at least in certain areas. Increased loading stability of the packaging, secure closure of the packaging as well as the possibility of an automated erecting and filling process of the packaging arise.

In further advantageous configurations of the packaging according to the invention, the bottom and/or lid flap are formed such that they completely or at least partially cover the area of a base surface of the packaging formed as a prismatic body formed by the sidewalls arranged on the end side in closure position of the packaging. Therein, there is the possibility that each two bottom and/or lid flaps are formed such that they completely cover the area of the base surface of the packaging formed by the sidewalls arranged on the end side in closure position. Thereby, it is ensured that independently of the base surface of the prismatically formed packaging, the surfaces formed by the sidewalls are reliably covered and closed by the bottom and/or lid flaps. Therein, the bottom and/or lid flap can each include at least two sections, wherein a first section hinged to the front or rear wall is formed widening towards an adjoining second section.

In a further advantageous configuration of the packaging according to the invention, at least one tear-off flap is formed in an area below the lid construction. Thereby, it is ensured that the products located in the packaging can be removed from the packaging in simple manner.

In further advantageous configurations of the packaging according to the invention, the bottom construction and/or the lid construction include at least one dust flap hinged to a bottom-side and/or lid-side end of at least one end-side sidewall. Therein, the dust flaps can be formed such that the bottom and/or lid flap at least partially come to rest at least partially on at least one of the dust flaps in a closure position. By these constructions according to the invention, secure closure of the packaging in the area of the bottom construction and/or the lid construction is ensured. In addition, there is the possibility that at least one of the dust flaps is also formed such that it at least partially protrudes beyond the base surface of the packaging and thereby beyond a corresponding sidewall, to which it is not hinged, and thus contributes to a secure closure and increased loading stability of the packaging in the area of the bottom and/or lid construction.

In further advantageous configurations of the packaging according to the invention, the base surface of the packaging formed as a prismatic body is polygonally, in particular tetra-, penta-, hexa-, hepta-, octa-, nona-, deca- or dodecagonally formed. Other shapes such as for example rounded shapes or mixed shapes are also conceivable. Furthermore, there is the possibility that the base surface of the packaging is triangularly formed. This embodiment can have an independent inventive content. In order to form the triangular shape of the packaging, either the front or the rear wall is connected via two sidewalls, which are in turn connected to each other. Therein, at least one bottom and/or lid flap hinged to the front or rear wall is formed such that it rests on at least one of the sidewalls at least in certain areas and protrudes beyond at least one sidewall, on which it rests, at least in certain areas in a closure position. By such a formation of the bottom and/or lid flap, secure closure and secure coverage of the packaging in the area of the lid and/or bottom construction, respectively, is ensured.

A further aspect of the invention relates to a blank for producing a packaging of cardboard, paper or the like, comprising front wall, rear wall and sidewall elements connected via bending lines for forming the packaging as a prismatic shape body in the folded state of the blank. Therein, the blank includes at least one lid and/or bottom flap hinged to the front and/or rear wall element. According to the invention, the at least one bottom flap hinged to the front or rear wall element and/or the at least one lid flap hinged to the front or rear wall element are each formed such that they rest on at least one side wall element connecting the front and rear wall elements at least in certain areas and protrude beyond at least one sidewall element, on which they rest, at least in certain areas in a closure position of the packaging. A blank thus formed ensures producing a packaging with a secure closure and a secure coverage in the area of the lid and/or bottom construction, respectively. In addition, the blank according to the invention results in increased loading stability of the packaging produced from it in the areas of the lid and/or bottom construction. The blank according to the invention can also be employed in automated erecting and filling processes without problems since more complex constructions such as for example correspondingly complex configurations of dust flaps can be omitted.

In a further advantageous configuration of the blank according to the invention, a width a of the at least one bottom flap hinged to the front or rear wall element and/or the at least one lid flap hinged to the front or rear wall element is larger than a width b of the front or rear wall elements in the area of the respective hinge of the bottom and/or lid flap. Thereby, it is constructively ensured that a secure closure and a corresponding increase of the loading stability of the packaging produced from the blank are possible.

In further advantageous configurations of the blank according to the invention, the bottom and/or lid flap each include at least two sectional areas, wherein a first sectional area hinged to the front or rear wall element is formed widening towards an adjoining second sectional area. There is the possibility that the bottom and/or lid flap are each formed separated from lateral dust flaps via cutting lines in this area, wherein the cutting lines are formed extending at an angle of 45 degrees±15 degrees and/or 135 degrees±15 degrees starting from a respective bending line of the corresponding sidewall elements. Thereby it is ensured on the one hand that a base surface of the packaging to be produced from the blank according to the invention is completely covered and thus securely closes the packaging. Furthermore, the construction advantageously allows producing the packaging from an integral blank. The latter results in distinct advantages with respect to the production speed as well as the production costs of the blank according to the invention and the packaging produced from it.

In a further advantageous configuration of the blank according to the invention, at least one dust flap hinged to a bottom-side and/or lid-side end of at least one end-side sidewall is formed. The dust flaps additionally serve for securely closing the packaging produced from the blank according to the invention. Furthermore, at least one dust flap can also be formed such that it protrudes beyond a base surface of the produced packaging and thereby beyond a corresponding sidewall of the packaging at least in certain areas. Thereby, further stability increase of the packaging produced from the blank according to the invention arises.

In a further advantageous configuration of the blank according to the invention, the blank includes a tear-off flap with a grip flap. Thereby, simply opening the packaging produced from the blank is ensured.

Figure 2:
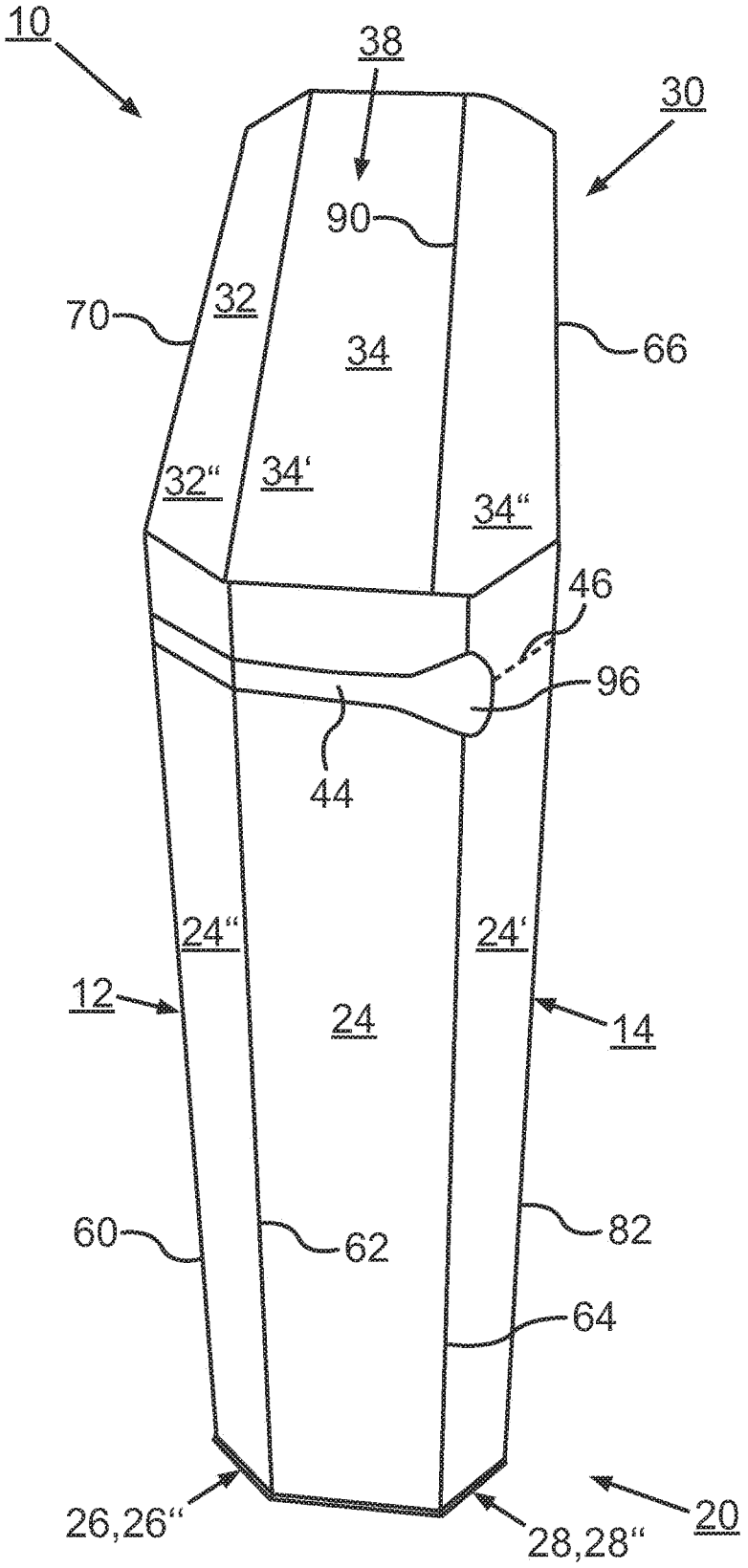
Figure 3:
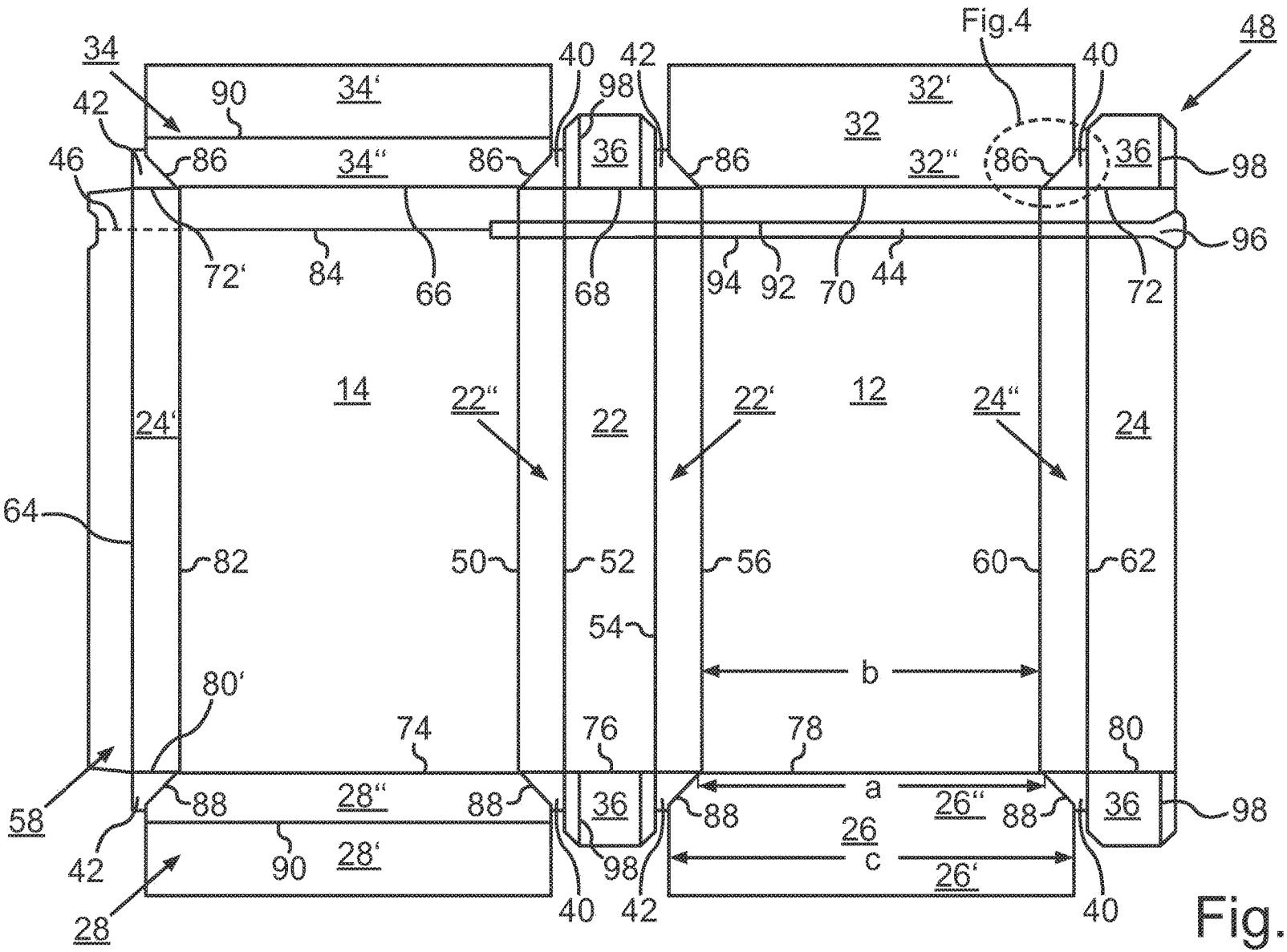
Figure 4:
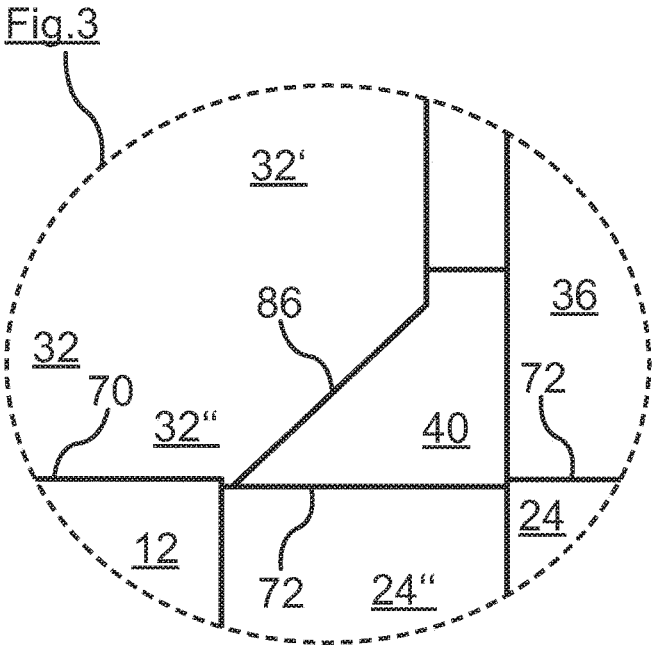

Further features of the invention are apparent from the claims, the embodiment as well as based on the drawings. The features and feature combinations mentioned above in the description as well as the features and feature combinations mentioned below in the embodiments are usable not only in the respectively specified combination, but also in other combinations without departing from the scope of the invention. There shows:

FIG. 1 a schematic lateral representation of a packaging according to the invention in closed state;

FIG. 2 a schematic representation of the packaging according to FIG. 1 from the front;

FIG. 3 a schematic representation of a blank according to the invention of the packaging according to FIG. 1; and FIG. 4 a schematic detailed representation of the blank shown in FIG. 3.

FIG. 1 shows a schematic representation of a packaging 10, which in particular serves for the storage and the transport of packaged or unpackaged pourable, powdery and free-flowing foods or detergents. However, liquids can also be stored in correspondingly liquid-tight intermediate packagings in the packaging 10. Therein, the packaging 10 comprises a front wall 12 and a rear wall 14, which are connected via each three sidewalls 22, 22', 22", 24, 24', 24" (see also FIGS. 2 and 3). The sidewalls 22, 22', 22", 24, 24', 24" constitute the end sides 16, 18 of the packaging 10. One recognizes that the packaging 10 is formed in the shape of a prismatic body along a longitudinal axis L extending parallel to the longitudinal extension of the front and rear walls 12, 14 and has an octagonal base surface 38. In addition, the packaging 10 comprises a bottom construction 20, which comprises each one bottom flap 26, 28 hinged to the front and rear walls 12, 14 for bottom-side closure of the packaging 10 (see also FIG. 3). Furthermore, the packaging 10 comprises a lid construction 30, wherein the lid construction 30 includes each one lid flap 32, 34 hinged to the front and rear walls 12, 14 for lid-side closure of the packaging.

One recognizes that the lid flaps 32, 34 each include two sectional areas 32', 32", 34', 34", wherein a first sectional area 32", 34" respectively hinged to the front and rear walls 12, 14 is formed widening towards the adjoining second sectional area 32' (not illustrated), 34'. The bottom flaps 26, 28 are correspondingly formed (not illustrated). Furthermore, one recognizes that the lid flaps 32, 34 are additionally formed such that they completely cover the area of a base surface 38 of the packaging 10 formed as a prismatic body formed by the sidewalls 22, 22', 22", 24, 24', 24" arranged on the end side in the closure position of the packaging 10. The same applies to the bottom flaps 26, 28 (not illustrated).

In addition, it becomes clear that the bottom and lid flaps 26, 28, 32, 34 are formed such that they rest on the sidewalls 22, 22', 22", 24, 24', 24" connecting the front and rear walls 12, 14 at least in certain areas and protrude beyond at least one of the sidewalls 22, 22', 22", 24, 24', 24" in certain areas in the illustrated closure position of the packaging 10. Thereby, considerable increase of the shape stability of the packaging 10 arises. In addition, secure closure of the packaging 10 is ensured. In order to constructively achieve this, a width a of the lid flaps 32, 34 hinged to the front or rear wall 12, 14 as well as the corresponding bottom flaps 26, 28 is larger than a width b of the front and rear walls 12, 14 in the area of the respective hinge of the lid and bottom flaps 32, 34. Therein, the width b corresponds to the length of the bending lines 66, 70, which are formed between the front wall 12 and the lid flap 32 and the rear wall 14 and the lid flap 34, respectively. The same applies to the bending lines 74, 78, which are formed between the front wall 12 and the bottom flap 26 and the rear wall 14 and the bottom flap 28, respectively (see also FIG. 3).

In addition, it becomes clear from FIG. 1 that the packaging 10 has an octagonal base shape 38. In order to achieve this, the front wall 12 is connected to respective sidewalls 22', 24' via corresponding bending lines 56, 60, wherein the sidewalls 22', 24" are in turn connected to the sidewalls 22, 24 via bending lines 54, 62 and they are connected to the sidewalls 22", 24' via the bending lines 52, 64 (compare also FIG. 2). The side walls 22", 24' are in turn connected to the rear wall 14 via corresponding bending lines 50, 82 (compare also FIG. 3). Therein, it is to be noted that the sidewall 24' is also connected to an adhesive flap 58 via the bending line 64, wherein the adhesive flap 58 is adhered to an inner side of the side wall 24 for producing the packaging 10 (not illustrated).

Furthermore, one recognizes that a grooving line 90 is formed in the sectional area 34" of the lid flap 34. This grooving line 90 extending parallel to the front and rear walls 12, 14 serves for stability increase of the lid flap 34. In an area below the lid construction 30, a tear-off flap 44 is additionally formed. Therein, the tear-off flap 44 is formed by means of the perforation lines 92, 94 extending parallel to each other in the area illustrated in FIG. 1.

FIG. 2 shows a further schematic representation of the packaging 10 according to FIG. 1 in a representation from the front. One again recognizes the overall octagonal configuration of the base surface 38 of the packaging 10. In addition, it becomes clear that the tear-off flap 44 terminates in a grip flap 96, wherein the grip flap 96 protrudes beyond the circumference of the packaging 10. The side surface 24 comprises a perforation 46 in the area and at the level of the tear-off flap 44, which detaches the lid construction 30 from the packaging 10 in this area after tearing the tear-off flap 44 and thus contributes to opening of the packaging 10. The perforation 46 transitions into a grooving line 84 on the rear side 14 (compare FIG. 3), which serves as a type of hinge for the lid construction 30. From FIG. 2, it again becomes clear that the bottom and lid flaps 26, 28, 32, 34 are formed such that they rest on the sidewalls 22, 22', 22", 24, 24', 24" connecting the front and rear walls 12, 14 in certain areas and protrude beyond them at least in certain areas.

FIG. 3 shows a schematic representation of a blank 48 of the packaging 10 according to FIG. 1. The blank 48 includes front wall, rear wall and sidewall elements 12, 14, 22, 22', 22", 24, 24', 24" connected via bending lines 50, 52, 54, 56, 60, 62, 64, 82 for forming the packaging 10 as a prismatic shape body in the folded state of the blank 48 (see FIGS. 1 and 2). One recognizes that the blank 48 comprises each one lid and bottom flap 32, 34, 26, 28 hinged to the respective front and rear wall elements 12, 14. A central dust flap 36 and lateral dust flaps 40, 42 are respectively hinged to the respective ends of the sidewalls 22, 22', 22", 24, 24', 24" via corresponding bending lines 68, 72, 72', 76, 80, 80'. The lid and bottom flaps 32, 34, 26, 28 are connected to the corresponding front and rear wall elements 12, 14 via corresponding bending lines 66, 70, 74, 78. In addition, an adhesive flap 58 is hinged to the sidewall element 24' via the bending line 64.

One recognizes that the bottom flap 26 hinged to the front wall element 12 as well as the lid flap 32 as well as also the bottom flap 28 hinged to the rear wall 14 and the corresponding lid flap 34 are respectively formed such that they rest on at least one of the sidewall elements 22, 22', 22", 24, 24', 24" connecting the front and rear wall elements 12, 14 at least in certain areas and protrude beyond at least one of these sidewall elements 22, 22', 22", 24, 24', 24", on which they rest, at least in certain areas in a closure position of the packaging 10 produced from the blank 48 (compare also FIGS. 1 and 2). In order to ensure this, the width a of the bottom flaps 26, 28 hinged to the front and rear wall elements 12, 14 and the lid flaps 32, 34 hinged to the front and rear wall elements 12, 14, respectively, is larger than the width b of the corresponding front and rear wall elements 12, 14 in the area of the respective hinge of the bottom and/or lid flaps 26, 28, 32, 34. In addition, it becomes clear that the bottom and lid flaps 26, 28, 32, 34 are each formed separated from the lateral dust flaps 40, 42 via corresponding cutting lines 86, 88, wherein the cutting lines 86, 88 are formed extending at an angle of circa 45 degrees or circa 135 degrees starting from the respective bending lines 68, 72, 72', 78, 80, 80' of the corresponding sidewall elements 22', 22", 24', 24".

In addition, it becomes clear from FIG. 3, that the bottom and lid flaps 26, 28, 32, 34 each include two sectional areas 26', 26", 28', 28", 32', 32", 34', 34", wherein a first sectional area 26", 28", 32", 34" hinged to the front or rear wall element 12, 14 is formed widening towards the adjoining second sectional area 26', 28', 32', 34'.

In addition, the configuration of the tear-off flap 44 becomes clear from FIG. 3. The tear-off flap 44 is in particular defined by the two perforation lines 92, 94. The tear-off flap 44 transitions into the grooving line 84 in the area of the rear wall element 14, which in turn transitions into a perforation 46, which is formed in the sidewall element 24' and the adhesive flap 58 in the illustrated embodiment. At the end opposing the perforation 46, the tear-off flap 44 terminates in the grip flap 96. From FIG. 3 too, the formation of the grooving lines 90 in the bottom flap 28 and the lid flap 34 is apparent. Further grooving lines 98 are formed in the central dust flaps 36 and herein too again serve for improving the stability of this element or this area of the blank 48 and the packaging 10, respectively.

FIG. 4 shows a schematic detailed representation of the blank shown in FIG. 3. One recognizes that the end of the sectional area 32" of the lid flap 32 only terminates in the area of the sidewall element 24". Therefore, the cutting line 86 intersects the bending line 72, which in turn connects the sidewall element 24" to the lateral dust flap 40. In addition, a slight offset of the bending line 70, via which the lid flap 32 is hinged to the front wall 12, to the bending line 72 is apparent.

Thereby, a type of overhang of the lid flap 32 arises in this area, wherein this overhang serves to protrude beyond the corresponding sidewall element 24" in the assembled state of the packaging 10. The same applies to the other end of the lid flap 32. The further lid flap 34 as well as the bottom flaps 26, 28 have constructions identical hereto.

The embodiments of the packaging 10 and the blank 48, respectively, described in the preceding figures serve for clarifying the basic principle of the present invention. In particular, a plurality of differently formed packagings is conceivable. Thus, the base surfaces 38 of the packaging 10 formed as a prismatic body can be formed not only in octagonal, but also in tetra-, penta-, hexa-, hepta-, nona-, deca- or dodecagonal manner. However, other shapes are also possible.

The above described packagings are formed as folding boxes. They are in particular composed of cardboard, paper, plastic or comparable materials like the associated blanks.

The invention claimed is:

1. A packaging of cardboard, paper or the like, comprising:

a front wall and a rear wall, and sidewalls connecting the front and rear walls, the sidewalls configured to form respective end sides of the packaging, wherein the packaging is formed in a shape of a prismatic body along a longitudinal axis, a bottom construction comprising at least one bottom flap hinged to the front or rear wall for bottom-side closure of the packaging, and a lid construction comprising a first lid flap hinged to the front wall and a second lid flap hinged to the rear wall for lid-side closure of the packaging, such that in a closure position the first and second lid flaps completely cover an area of a base surface of the prismatic body, wherein the at least one bottom flap hinged to the front or rear wall and/or at least one of the first and second lid flaps are each formed such that they rest on at least one sidewall connecting the front and rear walls at least in certain areas and protrude beyond the at least one sidewall, on which they rest, at least in certain areas in a closure position, wherein the lid construction includes at least one lateral dust flap hinged to a lid-side end of at least one sidewall and disposed adjacent to one of the first and second lid flaps, wherein the one of the first and second lid flaps being formed respectively separated from the at least one lateral dust flap via a cutting line, and wherein the cutting line extends at an angle of 45°±15° or 135°±15° starting from a respective bending line between the at least one lateral dust flap and the lid-side end of the at least one sidewall, is spaced away from a bending line between the first lid flap or the second lid flap and the rear wall or the front wall, and is spaced away from a bending line between the at least one sidewall with the at least one lateral dust flap and the rear wall or the front wall.

2. The packaging according to claim 1, wherein a width of the at least one bottom flap hinged to the front or rear wall and/or of at least one of the first lid flap and second lid flap is larger than a width of the front or rear wall in the area of the respective hinge of the bottom and/or first and/or second lid flap.

3. The packaging according to claim 1, wherein the bottom flap is formed such that in a closure position it completely or at least partially covers an area of a second base surface of the prismatic body.

4. The packaging according to claim 1, wherein the at least one bottom flap is comprised of a first bottom flap and a second bottom flap that are configured in a closure position to completely cover an area of a second base surface of the prismatic body.

5. The packaging according to claim 1, wherein the bottom, first lid and/or second lid flaps each include at least two sectional areas, wherein a first sectional area hinged to the front or rear wall is formed widening towards an adjoining second sectional area.

6. The packaging according to claim 1, wherein at least one tear-off flap is formed in an area below the lid construction.

7. The packaging according to claim 1, wherein the bottom construction includes at least one dust flap hinged to a bottom-side end of at least one other sidewall.

8. The packaging according to claim 7, wherein the at least one bottom flap at least partially comes to rest on the at least one dust flap in a closure position.

9. The packaging according to claim 1, wherein the base surface of the prismatic body is polygonally, in particular tetra-, penta-, hexa-, hepta-, octa-, nona-, deca- or dodecagonally formed.

10. The packaging according to claim 1, wherein the lid construction includes at least one dust flap hinged to a lid-side end of at least one other sidewall.

11. The packaging according to claim 10, wherein at least one of the first lid flap and the second lid flap at least partially comes to rest on the at least one dust flap in the closure position.

12. A blank for the production of a packaging of cardboard, paper or the like, comprising:

front wall, rear wall and sidewall elements connected via bending lines for forming the packaging as a prismatic shape body in a folded state of the blank, wherein the blank includes at least one lid flap and at least one bottom flap hinged to the front and/or rear wall elements, wherein the at least one bottom flap hinged to the front or rear wall element and/or the at least one lid flap hinged to the front or rear wall element are each formed such that they rest on at least one sidewall element connecting the front and rear wall elements at least in certain areas and protrude beyond the at least one sidewall element, on which they rest, at least in certain areas in a closure position of the packaging, wherein at least one lateral dust flap is formed to hinge on a bottom-side end or a lid-side end of at least one sidewall element, and wherein the at least one bottom flap or lid flap formed adjacent to the at least one lateral dust flap is respectively separated from the at least one lateral dust flap via a cutting line, wherein the cutting line is formed to extend at an angle of 45°±15° and/or 135°±15° starting from a respective bending line between the at least one lateral dust flap and the bottom-side end or the lid-side end of the at least one sidewall element, is spaced away from a bending line between the at least one lid flap or the at least one bottom flap and the front wall element or the rear wall element, and is spaced away from a bending line between the at least one sidewall element with the at least one lateral dust flap and the rear wall element or the front wall element.

13. The blank according to claim 12, wherein a width of the at least one bottom flap hinged to the front or rear wall element and/or the at least one lid flap hinged to the front or rear wall element is larger than a width of the front or rear wall elements in an area of the respective hinge of the bottom and/or lid flap.

14. The blank according to claim 12, wherein the at least one bottom flap and/or the at least one lid flap each include at least two sectional areas, wherein a first sectional area hinged to the front or rear wall element is formed widening towards an adjoining second sectional area.

15. The blank according to claim 12, wherein at least one dust flap is formed to hinge to a bottom-side end and/or a lid-side end of at least one other sidewall element.

16. The blank according to claim 12, wherein the blank includes a tear-off flap with a grip flap.

* * * * *